US005882794A

United States Patent [19]

Hernandez et al.

[11] Patent Number: 5,882,794

[45] **Date of Patent: *Mar. 16, 1999**

[54] SYNTHETIC FIBER CROSS-SECTION

[75] Inventors: Ismael Antonio Hernandez, Winterville; William Jonas Jones, Jr., Greenville; Darren Scott Quinn, Goldsboro, all of N.C.

[73] Assignee: E. I. du Pont de Nemours and Company, Wilmington, Del.

[ * ] Notice: The term of this patent shall not extend beyond the expiration date of Pat. No. 5,458,971.

[21] Appl. No.: 971,063

[22] Filed: Nov. 14, 1997

Related U.S. Application Data

[63] Continuation-in-part of Ser. No. 794,101, Feb. 3, 1997, Pat. No. 5,723,215, which is a continuation-in-part of Ser. No. 542,974, Oct. 13, 1995, Pat. No. 5,683,811, which is a continuation-in-part of Ser. No. 315,748, Sep. 30, 1994, Pat. No. 5,458,971.

[51] Int. Cl.[6] ..... D02G 3/00

[52] U.S. Cl. ..... 428/397; 428/398; 428/376

[58] Field of Search ..... 428/373, 374, 428/369, 376, 362, 398, 397

[56] References Cited

U.S. PATENT DOCUMENTS

| | | | |
|---|---|---|---|
| 3,328,850 | 7/1967 | Watson | 19/65 |
| 3,520,770 | 7/1970 | Shima et al. | 161/173 |
| 3,745,061 | 7/1973 | Champaneria et al. | 161/178 |
| 3,772,137 | 11/1973 | Tolliver | 428/369 |
| 3,952,134 | 4/1976 | Watson | 428/391 |
| 4,618,531 | 10/1986 | Marcus | 428/283 |
| 4,794,038 | 12/1988 | Marcus | 428/288 |
| 4,818,599 | 4/1989 | Marcus | 428/224 |
| 5,104,725 | 4/1992 | Broaddus | 428/224 |
| 5,112,684 | 5/1992 | Halm et al. | 428/357 |
| 5,141,805 | 8/1992 | Nohara et al. | 428/362 |
| 5,458,971 | 10/1995 | Hernandez et al. | 428/373 |
| 5,683,811 | 11/1997 | Hernandez et al. | 428/397 |
| 5,723,215 | 3/1998 | Hernandez et al. | 428/373 |

FOREIGN PATENT DOCUMENTS

| | | |
|---|---|---|
| 267684 | 10/1969 | European Pat. Off. . |
| 1168759 | 8/1988 | United Kingdom . |

*Primary Examiner*—Newton Edwards

[57] ABSTRACT

Synthetic fibers that have a round cross-section and three round longitudinal voids.

1 Claim, 2 Drawing Sheets

SYNTHETIC FIBER CROSS-SECTION

CROSS-REFERENCE TO RELATED APPLICATION

This application is a continuation-in-part of our application No. 08/794,101, filed Feb. 3, 1997 (DP-6320-D), now U.S. Pat. No. 5,723,215, which is itself a continuation-in-part of our application No. 08/542,974 (DP-6320-C) filed Oct. 13, 1995, now issued as U.S. Pat. No. 5,683,811, which is itself a continuation-in-part of our application Ser. No. 08/315,748 (DP-6320) filed Sept. 30, 1994, now issued as U.S. Pat. No. 5,458,971, the disclosures of all of which are hereby incorporated herein by reference.

FIELD OF THE INVENTION

This invention concerns a new cross-section for synthetic fibers, especially such as may be used as filling materials for pillows and other filled articles, as disclosed in our previous applications, referred to hereinabove, the disclosures of which are hereby expressly incorporated by reference, and which may have other uses.

BACKGROUND ART

The present invention was made in the course of developing improvements in polyester fiberfill. Polyester fiberfill filling material is sometimes referred to as polyester fiberfill and has become well accepted as a reasonably inexpensive filling and/or insulating material especially for pillows, and also for cushions and other furnishing materials, including other bedding materials, such as sleeping bags, mattress pads, quilts and comforters and including duvets, and in apparel, such as parkas and other insulated articles of apparel, because of its bulk filling power, aesthetic qualities and various advantages over other filling materials, so is now manufactured and used in large quantities commercially.

Polyester fibers with longitudinal voids have generally been preferred for use as filling fibers over solid filaments, and improvements in our ability to make such polyester fiberfill with a round periphery has been an important reason for the commercial acceptance of polyester fiberfill as a preferred filling material. Examples of fiber cross-sections with longitudinal voids are those with a single void, such as disclosed by Tolliver, U.S. Pat. No. 3,772,137, and by Glanzstoff, GB 1,168,759, 4-hole, such as disclosed in EPA 2 67,684 (Jones and Kohli), and 7-hole, disclosed by Broaddus, U.S. Pat. No. 5,104,725, all of which have been used commercially as hollow polyester fiberfill filling material. Most commercial filling material has been used in the form of cut fibers (often referred to as staple) but some filling material, including polyester fiberfill filling material, has been used in the form of deregistered tows of continuous filaments, as disclosed, for example by Watson, U.S. Pat. Nos. 3,952,134, and 3,328,850.

We use herein both terms "fiber" and "filament" inclusively without intending use of one term to exclude the other.

Practically all of the polyester fiber that has been manufactured commercially hitherto has been based on ethylene glycol (2G) and on terephthalic acid (T), and ethylene terephthalate polymers have sometimes been referred to as 2G-T, accordingly. Such polyesters have been preferred because of cost and availability, but others have been mentioned in the literature, such as 3G-T (sometimes referred to as PTT) and 4G-T for example. The present invention is not limited to fibers of 2G-T polyesters, but may be applied to other glycol terephthalate polyester fibers, such as of 3G-T or 4G-T, for example, and copolyesters. Indeed, the present invention is not limited to polyester fibers, but is believed broadly applicable to synthetic fibers, generally, and especially to those prepared by spinning filaments from a melt of the synthetic polymer, including polyamides, such as nylon 6,6 and nylon 6, polyolefins, such as polypropylene and polyethylene by way of example, but, as will be understood, since the invention was made in the course of melt-spinning polyester filaments, most of the description hereinafter discusses application of the invention to polyester filaments, and especially to bicomponent filaments such as are described and claimed in our previous applications, referred to hereinbefore.

Champaneria et al. U.S. Pat. No. 3,745,061 disclosed synthetic filaments having at least three continuous non-round voids. FIG. 2 of Champaneria is an enlarged sectional view taken from a photomicrograph of a nylon filament spun through an orifice similar to Champanerial's FIG. 1 except for omission of one segment. FIG. 1 of Champaneria represents a spinneret orifice for spinning filaments containing four, substantially equi-dimensional and equi-spaced, parallel continuous voids, such as nylon filaments of cross-section as shown in FIGS. 1*a*, 1*b* and 1*c* of Champaneria. As indicated, all the voids of Champaneria's filaments were "non-round". Champaneria did not illustrate any spinneret orifice for spinning filaments with three voids. The spinneret orifice shown in Champaneria's FIG. 1 was segmented with slot segments and spokes. Such spokes are shown terminating toward the center of the orifice with squared ends. Champaneria did not disclose any filaments with round voids, i.e., of essentially circular cross-section. All the filament cross-sections illustrated by Champaneria in his FIGS. 1*a*, 1*b*, 1*c*, 2 and 3 had the non-round voids desired by Champaneria. Champaneria did not teach how to spin filaments with round voids.

SUMMARY OF THE INVENTION

According to the present invention, we provide multi-void synthetic fibers of round cross-section having three longitudinal voids that are of essentially similar circular cross-section and that are essentially equi-spaced.

We believe no one previously disclosed how to spin round filaments with three round holes.

Also provided are new processes and new spinnerets for making our new filaments.

Such a process for preparing filaments having three continuous round voids throughout their fiber length, comprises the steps of post-coalescence melt-spinning polyester (or other synthetic polymer) into filaments through segmented spinning capillary orifices so the resulting freshly-spun molten streams coalesce and form continuous filaments having three round continuous voids throughout their fiber length, and quenching to solidify the filaments, and, if desired, drawing the resultant solid filaments and heating to relax them, and otherwise processing such filaments.

Such processes include those wherein the continuous filaments are converted to staple fiber. A particularly advantageous such process includes one wherein the staple fiber is formed into fiberballs having a random distribution and entanglement of fibers within each ball, and having an average diameter of 2–20mm, and wherein the individual fibers have a length of 10–100 mm.

Fiberfill fibers are preferably slickened, i.e., are coated with a durable slickener, as disclosed in the art. As, for example, disclosed in our previous applications, blends (mixtures) of slickened and unslickened fiberfill fibers may have processing advantages.

DETAILED DESCRIPTION OF THE INVENTION

As indicated hereinbefore, the disclosures of our prior applications, now U.S. Pat. Nos. 5,458,971 (DP-6320), and 5,683,811 (DP-6320-C), and application Ser. No. 08/794,101 (DP-6320-D), are incorporated herein by reference, so it would be redundant to repeat all of their disclosures, but some is repeated hereinafter for convenience.

For fiberfill uses, suitable filament deniers have generally ranged from 1.5 to 20 dtex for the final drawn fibers, 2–16 dtex having been preferred in most cases, and 4–10 dtex having been generally most preferred, it being understood that blends of different deniers may often be desirable. Currently, there is special interest in low deniers (e.g. subdenier fibers), especially for insulating and/or aesthetic purposes.

A preferred round multivoid filament is now described and illustrated in the accompanying Drawings.

Figure 1:
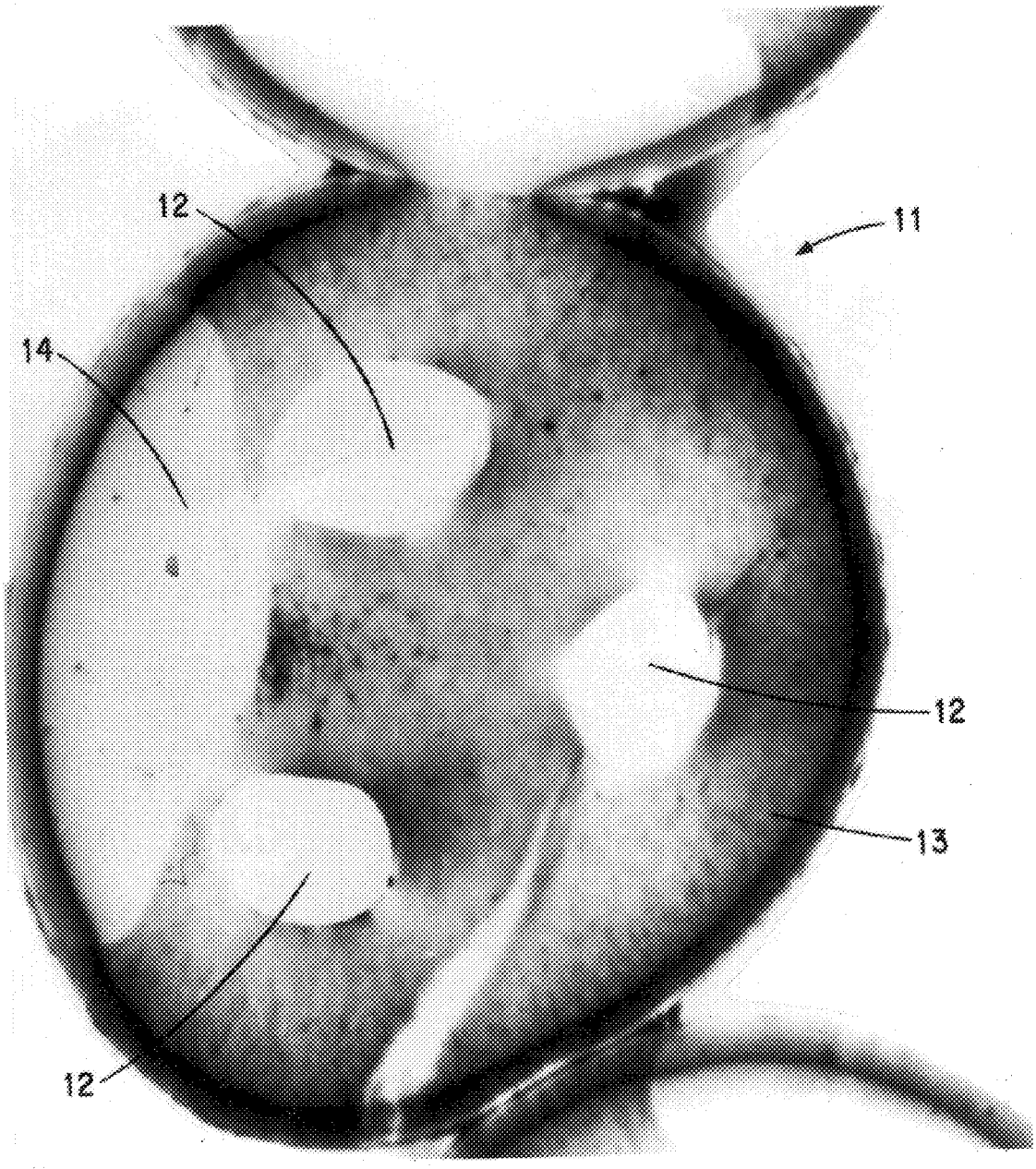
FIG. 1 is an enlarged photograph of a cross-section of a preferred 3-hole filament embodiment of the invention.
Figure 2:
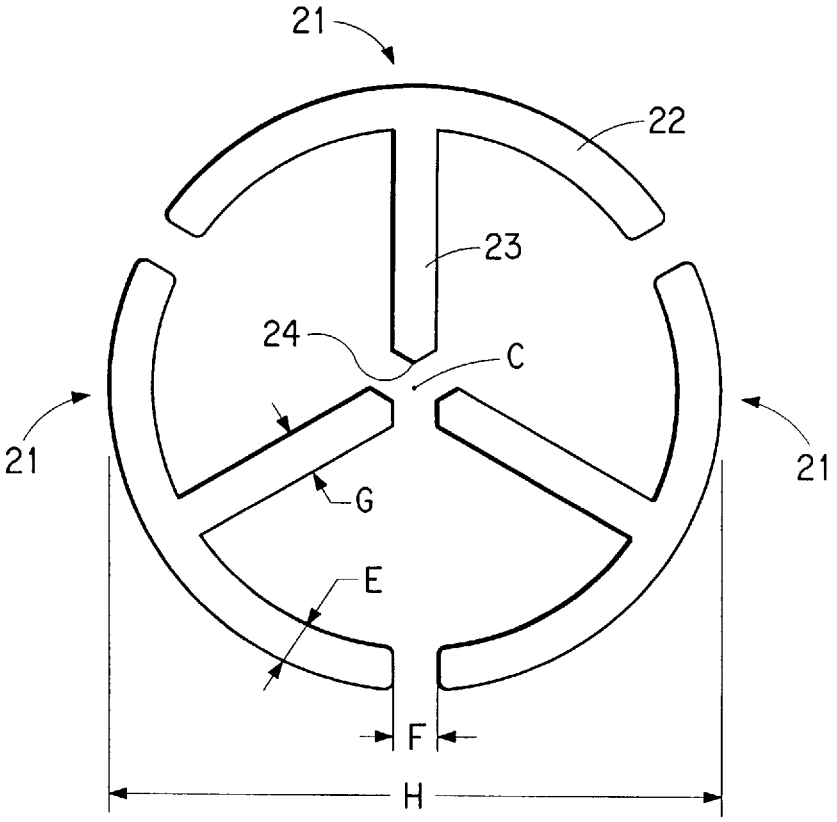
FIG. 2 is an enlarged view of a spinneret capillary according to the invention viewed from the lower surface of the spinneret, for spinning a 3-hole filament.

Referring to the accompanying Drawings, FIG. 1 is a photograph to show a cross-section of a 3-hole bicomponent filament spun from a spinneret capillary as shown in FIG. 2. The filament generally is indicated by reference numeral 11, and contains three voids 12 of essentially similar circular cross-section. Two polymeric components 13 and 14 are shown with a clearly defined borderline between these different components. This boundary was visible after the filament cross-section had been stained with osmium tetroxide, which stained the components differently so the borderline shows up better. In this instance, all three voids 11 are shown located within the majority polymeric component 13. It will be understood that this will not necessarily happen, especially when more of a second component is present than shown in FIG. 3 for component 14. Furthermore, the present invention is not limited to bicomponent filaments, but monocomponent filaments with three such voids are also contemplated according to the present invention. The filaments are of round (circular) cross-section, which is important and preferred for fiberfill materials.

FIG. 2 shows a spinneret capillary for spinning round filaments with three round voids. It will be noted that the capillary is segmented, with three segments 21 disposed symmetrically around an axis or central point C. Each segment 21 consist of two slots, namely a peripheral arcuate slot 22 (width E) and a radial slot 23 (width G), the middle of the inside edge of peripheral arcuate slot 22 being joined to the outer end of radial slot 23, so each segment forms a kind of "T-shape" with the top of the T being curved convexly to form an arc of a circle. Each peripheral arcuate slot 22 extends almost 120° around the circumference of the circle. Each radial slot 23 comes to a point 24 at its inner end. Points 24 are spaced from central point C. Outer diameter H of the capillary is defined by the distance between the outer edges of peripheral arcuate slots 22. Each peripheral arcuate slot 22 is separated from its neighbor by a distance F, which is referred to as a "tab".

The short faces of neighboring peripheral arcuate slots 22 on either side of each tab are parallel to each other and parallel to the radius that bisects such tab. In many respects, the capillary design shown in FIG. 2 is typical of designs used in the art to provide hollow filaments by post-coalescence spinning through segmented orifices. Points 24 at the inner ends of radial slots 23 are provided in the spinneret capillary design shown in FIG. 2 to improve coalescence of the polymer at the center of the filament, i.e., to ensure that the three voids do not become connected.

TEST METHODS

The parameters mentioned herein are standard parameters and are mentioned in the art referenced herein, as are methods for measuring them.

Properties of the fibers were mostly measured essentially as described by Tolliver in U.S. Pat. No. 3,772,137, except as explained by Hernandez in U.S. Pat. No. 5,458,971, which is incorporated herein by reference. Thus, the BL1 and BL2 heights are measured in inches, BL1 at 0.001 psi (about 7 $N/m^2$), and BL2 at 0.2 psi (about 1400 $N/m^2$). Metric equivalents are given, as needed after conventional units. Crimp takeup (CTU) was measured as follows:

ROPE CRIMP TAKE-UP

A rope of known denier at least 1.5 meters in length is prepared for measurement by placing a knot in both ends. The resulting sample is subjected to a load of 125 mg/den. Two metal clips are placed across the extended rope at a distance apart of exactly 100 centimeters. The two ends of the rope are cut off within 1–2 inches beyond the clips. The resulting cut band is hung vertically and the recovered crimped length between the clips is measured to the nearest 0.5 centimeters. Crimp take-up is calculated using the following equation $$\% CTU = \frac{A - B}{A} \times 100$$

where A is the extended length, 100 centimeters, B is the retracted crimp length in centimeters.

Friction, was measured by the SPF (Staple Pad Friction) method, as described hereinafter, and for example, in U.S. Pat. No. 5,683,811 (DP-6320-C), referred to above.

As used herein, a staple pad of the fibers whose friction is to be measured is sandwiched between a weight on top of the staple pad and a base that is underneath the staple pad and is mounted on the lower crosshead of an Instron 1122 machine (product of Instron Engineering Corp., Canton, Mass.).

The staple pad is prepared by carding the staple fibers (using a SACO-Lowell roller top card) to form a batt which is cut into sections, that are 4.0 ins in length and 2.5 ins wide, with the fibers oriented in the length dimension of the batt. Enough sections are stacked up so the staple pad weighs 1.5 g. The weight on top of the staple pad is of length (L) 1.88 ins, width (W) 1.52 ins, and height (H) 1.46 ins, and weighs 496 gm. The surfaces of the weight and of the base that contact the staple pad are covered with Emery cloth (grit being in 220–240 range), so that it is the Emery cloth that makes contact with the surfaces of the staple pad. The staple pad is placed on the base. The weight is placed on the middle of the pad. A nylon monofil line is attached to one of the smaller vertical (WxH) faces of the weight and passed around a small pulley up to the upper crosshead of the Instron, making a 90 degree wrap angle around the pulley.

A computer interfaced to the Instron is given a signal to start the test. The lower crosshead of the Instron is moved down at a speed of 12.5 in/min. The staple pad, the weight and the pulley are also moved down with the base, which is mounted on the lower crosshead. Tension increases in the nylon monofil as it is stretched between the weight, which is moving down, and the upper crosshead, which remains stationary. Tension is applied to the weight in a horizontal direction, which is the direction of orientation of the fibers in the staple pad. Initially, there is little or no movement within the staple pad. The force applied to the upper crosshead of the Instron is monitored by a load cell and increases to a threshold level, when the fibers in the pad start moving past each other. (Because of the Emery cloth at the interfaces with the staple pad, there is little relative motion at these interfaces; essentially any motion results from fibers within the staple pad moving past each other.) The threshold force level indicates what is required to overcome the fiber-to-fiber static friction and is recorded.

The coefficient of friction is determined by dividing the measured threshold force by the 496 gm weight. Eight values are used to compute the average SPF. These eight values are obtained by making four determinations on each of two staple pad samples.

The invention is further illustrated in the following Examples; all parts and percentages are by weight, unless otherwise indicated. The spinneret capillary used for spinning 3-hole polyester fiber in the Examples was as illustrated in FIG. 2, with the following dimensions in inches: H(outer diameter) 0.060 inches; E(width of slot 22), F (tab) and G(width of slot 23) all 0.004 inches; points 24 were defined by the faces at the inner end of each radial slot 23 on either side of point 24, each such face being aligned with a short face at the extremity of the corresponding peripheral arcuate slot 22, i.e., on one side of a tab of width F, so as to provide corresponding distances also of width F (0.004 inches) between each pair of parallel faces at the inner ends of each pair of radial slots 23. The capillary slots were of depth 0.010 inches, and were fed from a reservoir as shown in FIG. 6A of U.S. Pat. No. 5,356,582 (Aneja et al) and with a meter plate registered for spinning side-by-side bicomponent filaments, as disclosed in the art.

EXAMPLE 1

Bicomponent fibers according to the invention were produced from two different component polymers, both of 0.66 IV. One component polymer (A) was homopoly(ethylene terephthalate), while the other component polymer (B) contained 3500 ppm of trimellitate chain-brancher (analyzed as trimethyl trimellitate, but added as trihydroxyethyl trimellitate). Each was processed simultaneously through a separate screw melter at a combined polymer throughput of 190 lbs/hr. (86 kg/hr). Use of a meter plate with orifices just above each of 1176 spinneret capillaries allowed these molten polymers to be combined in a side-by-side manner in a ratio of 80% (A) and 20% (B) and spun into filaments at 0.162 lbs/hr/capillary (0.074 kg/hr/capillary) and 500 ypm (457 m/min). The post-coalescent capillaries (FIG. 2) were designed to give fibers with three equi-spaced and equi-sized voids parallel to the fiber axis. The resulting hollow fibers (of spun denier=25 and void content 12.5%.) were quenched in a cross-flow manner with air at 55° F. (18° C.). The spun fibers were grouped together to form a rope (relaxed tow denier of 360,000). This rope was drawn in a hot wet spray draw zone maintained at 95° C. using a draw ratio of 3.5 ×. The drawn filaments were coated with a slickening agent containing a polyaminosiloxane and laid down with an air jet on a conveyor. The filaments in the rope on the conveyor were now observed to have helical crimp. The (crimped) rope was relaxed in an oven at 175° C, after which it was cooled, and an antistatic finish was applied at about 0.5% by weight, after which the rope was cut in a conventional manner to 3 in. (76 mm). The finished product had a denier per filament of 8.9. The fibers had a cross section similar to that shown in FIG. 1 (which fiber actually contained slightly different (82/18) proportions of polymer A/B), containing three continuous round voids which were parallel and substantially equal in size and substantially equi-spaced from each other. The periphery of the fiber was round and smooth. Various properties of the fibers were measured and are compared in Table 1A, with commercial bicomponent fibers of the delta-RV type marketed by Unitika (Japan) and Sam Yang (South Korea).

Pillows were prepared from cut bicomponent staples of the Example above and also from the commercially available 6-H18Y (Unitika) and 7-HCS (Sam Yang) by being opened by passing though a picker and were then processed on a garnett (such as a single cylinder double doffer model manufactured by James Hunter Machine Co. of North Adams, Mass.). Two webs of opened fibers were combined and rolled up to form pillow batting. The weight of each pillow was adjusted to 18 oz. (509) gm) and each was then conveyed into 20 in. (51 cm)×26 in. (66 cm) tickings of 200 count 100% cotton fabric using a Bemiss pillow stuffer. The pillows (after a refluffing) were measured for Initial Height and Firmness, which are shown in Table 1B.

The 18 oz (509 gm) pillows of the invention made by this Example have very good filling power, much more so than typical mechanically-crimped slickened fibers, to the extent that we believe that such a pillow filled with as little as 18 oz of our novel hollow bicomponent spiral crimp fiber can provide as much as filling power in a pillow as a prior art pillow filled with 20 oz of commercial mechanically crimped fiber, which is a significant saving; there is also an economic advantage in avoiding the need to use a stuffer box (for mechanical crimping) which can also risk damaging the fibers. These pillows had Initial Height superior to 7-HCS and about equivalent to H-18Y. In contrast to 18 oz (509 gm) pillows with good filling power of the art, these pillows of Example 1 were firm. Their Firmness was greater than for either competitive fiber. An important advantage of such pillows over pillows filled with prior commercially-available spiral crimp fiber is also the versatility and flexibility that use of our technology provides, as will be shown in Example 2.

TABLE 1A

Physical Properties of Bicomponent Fibers

| Item | Example 1 | H18Y | 7-HCS |
|---|---|---|---|
| DPF | 8.9 | 6.0 | 7.0 |
| Crimp/inch (cm) | 6.1 (15.5) | 5.0 (12.7) | 5.4 (11.9) |
| % void | 11.4 | 25.1 | 3.8 |
| TBRM | | | |
| In. (cm @ 0.001 PSI | 5.56 (14.1) | 5.81 (14.8) | 5.76 (14.6) |
| in. (cm @ 0.2 PSI | 0.66 (1.68) | 0.56 (1.42) | 0.36 (0.91) |
| Staple Pad Friction | 0.353 | 0.262 | 0.246 |
| % silicon | 0.324 | 0.210 | 0.215 |

TABLE 1B

Properties of 18 oz. rolled batting pillows

| Item | Example 1 | H18Y | 7-HCS |
|---|---|---|---|
| Initial Pillow | | | |
| Height in (cm) | 8.98 (19.8) | 9.18 (23.3) | 7.69 (19.8) |
| Firmness lbs (kg) | 7.97 (3.62) | 7.04 (3.20) | 3.29 (1.50) |

EXAMPLE 2

A series of bicomponent fibers with differing crimp frequencies were prepared by varying the ratio of the two polymer components, A and B, of Example 1. The proportion of polymer A was varied from 70% up to 84% as the proportion of polymer B was varied from 30% down 30% to 16% as shown in Table 3. Using the same spinning process as in Example 1, the differing polymer combinations were spun into a series of bicomponent fibers having visually different crimp frequencies. Their physical properties are given in Table 2. Each of these fibers was converted into standard roll batting pillows as in Example 1. The properties of the pillows are given in Table 2. In general, an increase in pillow Firmness was noted as the content of polymer B in the fiber was increased from 16% to 22%, corresponding to the increase in crimp frequency obtained for the bicomponent fibers, a B polymer content of 22% giving a crimp frequency of about 7 cpi and a pillow Firmness of about 10 lbs, both of which are even better than those of the pillow of Example 1 which, in turn, had values better than those of the commercially available products (as shown in Table 1), while a B polymer content of 30% gave an even higher void content and good values of crimp frequency and Firmness.

TABLE 2

PROPERTIES OF FIBERS AND PILLOWS IN CRIMP SERIES

| Item | A | B | C | D |
|---|---|---|---|---|
| % polymer A | 70 | 78 | 80 | 84 |
| % polymer B | 30 | 22 | 20 | 16 |
| DPF | 8.7 | 8.8 | 8.9 | 9.6 |
| Crimp/in (cm) | 6.8 (17.3) | 7.1 (18.0) | 5.7 (14.5) | 3.9 (9.90) |
| % void | 14.6 | 11.4 | 11.5 | 9.4 |
| TBRM Height | | | | |
| In (cm) @ .001 PSI | 4.52 (11.5) | 5.24 (13.3) | 5.54 (14.1) | 5.64 (14.3) |
| In (cm) @ .2 PSI | 0.95 (2.4) | 0.82 (2.1) | 0.65 (1.7) | 0.50 (1.3 |
| SPF | 0.558 | 0.405 | 0.355 | 0.294 |
| % silicon | 0.313 | 0.317 | 0.324 | 0.303 |
| Initial pillow: | | | | |
| Height, in (cm) | 9.40 (23.9) | 9.14 (23.2) | 8.98 (22.8) | 9.16 (23.3) |
| Firmness, lbs (kg) | 9.20 (4.18) | 10.02 (4.55) | 7.97 (3.62) | 6.33 (2.87) |

Preferred proportions of the different polymers in such bicomponent fibers range from about 10/90 to 30/70. In Example 2, one component was branched with 3500 ppm (measured as disclosed above) of a chain-brancher which is preferred for reasons discussed in EPA published application 0,294,912, but other chain-branchers as disclosed therein and by Shima may, if desired be used, and, with this preferred chain-brancher, such proportions correspond to crimp frequencies of about 2–8 CPI, respectively. Even 50/50 bicomponent proportions would be expected to be useful if modifications were made to various features, such as the amount of chain-brancher, for instance using about 700 ppm, whereas proportions of 10/90 might give useful results with as much as 17,500 ppm (the chain-brancher being measured as disclosed above)

Preferred void contents in multi-void fibers according to our invention range from 5% up to 40%, especially 10–30%.

EXAMPLE 3

Because opened slickened bicomponent fibers give such weak web cohesion that some find it difficult to combine the webs into batting and to handle the batting in a pillow ticking stuffing operation, we combined a minor proportion of unslickened fibers with a majority of slickened fibers in the cutting operation. A 75%/25% slickened/unslickened blend was prepared by cutting three 390,000 denier ropes of the slickened fiber from item B in Example 2 combined with one equivalent rope of the same bicomponent fiber to which no silicone slickener had been applied. The resulting staple blend (cut length 3 inches, 7.6 cm) had a noted increase in fiber-fiber friction as measured by an SPF increase from 0.391 to 0.412. This blend was processed easily on a garnett with much improved operability vs. the all-slickened product of item B of Example 2 into 18 oz with the pillow of the all-slick product in Example 2, item B. A comparison of pillow properties in Table 3 before and after a stomp/wash/dry cycle shows that the addition of unslickened fiber did not adversely affect the advantageous properties of the pillow.

TABLE 3

Properties of Blended Bicomponent Pillows

| | 75/25 slickened/ non-slick blend | | all-slick | |
|---|---|---|---|---|
| | height in (cm) | firmness lbs (kg) | height in (cm) | firmness lbs. (kg) |
| Initial Pillow | 9.16 (23.3) | 9.68 (4.40) | 9.14 (23.2) | 10.02 (4.55) |
| After stomp/ wash cycle | 9.06 (23.0) | 6.70 (3.05) | 9.01 (22.9) | 7.00 (3.18) |

The proportions of slickened to unslickened bicomponent polyester fiberfill fibers may be varied as desired for aesthetic purposes and/or as needed or desirable for processing, e.g. as little as 5 or 10% of one type of fiber, or more, and the 25/75 mixture used in Example 3 is not intended to be limiting and may not even be optimum for some purposes.

EXAMPLE 4

Bicomponent fibers were prepared from two different glycol terephthalate polyester polymers, each having an IV of 0.66, essentially as described in Example 1, except as indicated. One component (A) was polyethylene terephthalate homopolymer (without chainbrancher). The other component (B) was ethylene terephthalate polymerized with the addition of 0.13 mole % of trimellitate chain-brancher (added as trihydroxyethyl trimellitate). Each was processed simultaneously through a separate extruder at a combined rate of 182 lbs./hr. (83 kg/hr.) per spin cell. Use of bicomponent metering and distribution plates allowed bicomponent spinning of these polymers in a side-by-side manner in each of 1176 spinneret capillaries within each spinning cell. The flow of these two polymers was controlled at a rate to give a polymer ratio of 78% A and 22% B at a throughput of 0.155 lb/hr./capillary (0.07 kg/hr/capillary). Each spinneret capillary was designed such as to give three continuous, equi-spaced and equi-sized round voids throughout the length of the filament and parallel to the filament's central axis. The resulting filaments were quenched with 1250 cfm (35 $m^3$/min) of 55° F. (18° C.) air per cell blowing across the filaments. The filaments had a void content of 12.5% and were spun at 500 ypm (457 mpm). The filaments were observed to exhibit no kneeing or bending as they left the spinneret capillaries, and yarn breakage was not a problem. The spun fibers were then grouped together to form a rope with a drawn/relaxed tow denier of 1,270,000 (1,410,000 dtex) and drawn through a wet draw bath maintained at 900 to 98° C. using a draw ratio of 3.15×. The drawn filaments were coated with a polyaminosiloxane slickening agent and laid down on a conveyor. Spiral crimps were observed at the point of lay down. This helical fiber was then processed through a drying oven operating at 170° C. after which it was cooled and an antistatic finish was applied.

This fiber was found to have the physical properties given in Table 4A.

TABLE 4A

| | |
|---|---|
| DPF (dtex) | 8.75 (9.7) |
| TBRM BL1 in (cm) | 5.1 (13) |
| TBRM BL2 in (cm) | 0.8 (2) |
| SPF | 0.442 |
| CPI (CPcm) | 7.3 (2.9) |
| CTU | 38% |

In addition, these fibers were tested for crimps using the methods described by Shima in U.S. Pat. No. 3,520,770. The average results of 10 single filament Shima measurements are given in Table 4B for the fibers of the invention (INV) and the data given in Shima's Table 1 are also listed for purposes of comparison; Shima's bicomponent fibers contained equal amounts (50/50) of the components in contrast to the 78/22 proportions for the fibers of our Example 4.

TABLE 4B

| | INV | SHIMA I | SHIMA II |
|---|---|---|---|
| Number of Crimps (per 25 mm) (Shima) | 9.2 | 10.5 | 13.1 |
| Apparent Percentage Crimp (Shima) | 16.9% | 16.8% | 18.2% |
| Residual Percentage Crimp (Shima) | 16.4% | 16.5% | 15.5% |
| Crimp Elasticity (Shima) | 97% | 98% | 92% |

EXAMPLE 5

Bicomponent filaments were spun essentially as described in Example 4 with the exception that the combined polymer throughput was 210 lb./hr. (95.3 kg/hr.) per spin cell, 0.18 lb./hr./capillary (0.08 kg/hr/capillary), and the polymer ratio A:B was 89:11, and were found to have physical properties as shown in Table 5.

TABLE 5

| | |
|---|---|
| DPF (dtex) | 6.8 (7.5) |
| TBRM BL1 in (cm) | 5.9 (15) |
| TBRM BL2 in (cm) | 0.4 (1) |
| SPF | 0.213 |
| CPI (CPcm) | 3.1 (1.2) |
| CTU | 42% |
| Number of Crimps (per 25 mm) (Shima) | 4.3 |
| Apparent Percentage Crimp (Shima) | 16.9% |
| Residual Percentage Crimp (Shima) | 16.9% |
| Crimp Elasticity (Shima) | 100% |

The fiber produced in this Example was found to have excellent high amplitude, low frequency, crimp formation, such as is extremely useful for filled articles and other uses where a soft hand is required.

As can be seen from the above data, the fibers of both Examples 4 and 5 exhibited excellent and useful crimp even though the amount of chain-brancher present in polymer B was only about half the required minimum taught by Shima, and even though polymer B comprised only 22% of our fiber in our Example 4 and only 11% of our fiber in our Example 5. In addition, we used no monofunctional compound to prevent problems such as kneeing and yarn breakage as taught by Shima. The melt viscosities of our two polymers were controlled during polymer formation so they were similar, despite the addition of chain-brancher to the B polymer.

What is claimed is:

1. Multi-void synthetic fibers of round cross-section having three longitudinal voids that are of essentially similar circular cross-section and that are essentially equi-spaced.

* * * * *